US011079200B2

(12) United States Patent
Samson et al.

(10) Patent No.: US 11,079,200 B2
(45) Date of Patent: Aug. 3, 2021

(54) UNDERFOLDING ARM BRACE APPARATUS FOR FIREARMS

(71) Applicant: Samson Manufacturing Corp., Keene, NH (US)

(72) Inventors: Scott Samson, Spofford, NH (US); Krzysztof Muskus, Keene, NH (US)

(73) Assignee: Samson Manufacturing Corporation, Keene, NH (US)

( * ) Notice: Subject to any disclaimer, the term of this patent is extended or adjusted under 35 U.S.C. 154(b) by 0 days.

(21) Appl. No.: 16/658,453

(22) Filed: Oct. 21, 2019

(65) Prior Publication Data

US 2020/0158463 A1 May 21, 2020

Related U.S. Application Data

(60) Provisional application No. 62/748,040, filed on Oct. 19, 2018.

(51) Int. Cl.
*F41C 23/04* (2006.01)

(52) U.S. Cl.
CPC ..... *F41C 23/04* (2013.01)

(58) Field of Classification Search
CPC ..... F41C 23/04; F41C 23/12; F41C 27/22; F41A 23/02
USPC ..... 42/71.01
See application file for complete search history.

(56) References Cited

U.S. PATENT DOCUMENTS

| | | | | |
|---|---|---|---|---|
| 46,365 | A * | 2/1865 | Kinman | F41C 33/001 42/94 |
| 784,390 | A * | 3/1905 | Dunham | F41C 33/001 42/94 |
| 915,481 | A * | 3/1909 | Roop | F41C 33/001 42/94 |
| 1,103,824 | A * | 7/1914 | Page | F41C 33/001 42/94 |
| 2,400,422 | A * | 5/1946 | Johnson, Jr. | F41C 23/00 42/71.01 |
| 4,844,390 | A * | 7/1989 | Duke | F16M 13/04 248/118 |
| 5,018,294 | A * | 5/1991 | McGuffee | F41A 23/02 42/94 |
| 7,337,573 | B1 * | 3/2008 | DiGiovanna | F41C 23/04 42/71.01 |
| 8,555,541 | B2 * | 10/2013 | Ingram | F41A 11/00 42/71.01 |
| 8,910,407 | B2 * | 12/2014 | Singh | F41C 23/12 42/71.02 |
| D722,672 | S | 2/2015 | Juarez | |
| D733,247 | S | 6/2015 | Lewis et al. | |
| 9,354,021 | B2 | 5/2016 | Bosco | |
| D763,396 | S | 8/2016 | Juarez | |

(Continued)

*Primary Examiner* — Samir Abdosh
(74) *Attorney, Agent, or Firm* — Burns & Levinson LLP; Bruce D. Jobse

(57) ABSTRACT

An arm brace apparatus for use with a firearm allows for a reduced form factor when the arm brace is not needed by the shooter. The arm brace apparatus includes a hinge which allows for a substantial portion of the brace to pivot between an open or deployed configuration, a useful position when shooting, and a closed or stowed position, useful for transportation or storage of the firearm to which the arm brace is attached. A latch mechanism allows the device to be locked in either the open or closed position.

16 Claims, 23 Drawing Sheets

(56) References Cited

U.S. PATENT DOCUMENTS

| | | | | |
|---|---|---|---|---|
| D774,619 | S | 12/2016 | Mather | |
| D868,924 | S | 12/2019 | Nuss et al. | |
| D871,536 | S | 12/2019 | Lessard et al. | |
| D900,271 | S * | 10/2020 | Faifer | D22/108 |
| 2005/0115140 | A1 * | 6/2005 | Little | F41C 23/04 42/118 |
| 2012/0174455 | A1 * | 7/2012 | Edelman | F41C 23/20 42/71.01 |
| 2016/0187092 | A1 | 6/2016 | Mather et al. | |
| 2016/0202016 | A1 | 7/2016 | Mather et al. | |
| 2019/0017777 | A1 | 1/2019 | Wilson et al. | |

* cited by examiner

FOLDING ARM BRACE
AR BUFFER TUBE 5
25
25
5
10

10
SHOWN IN DEPLOYED POSITION

UNDERFOLDING ARM BRACE APPARATUS FOR FIREARMS

FIELD OF THE INVENTION

The disclosure relates to firearms accessories and, more specifically, to an arm brace for use with a firearm.

BACKGROUND

U.S. Pat. Nos. 8,869,444, 9,354,021 and 9,664,477 disclose various arm braces for use with a firearm as described which allow shooters with disabilities to stabilize their forearm with the use of a bracing device. The disclosed devices, however, are relatively rigid in their respective designs and do not allow provisions for the bracing device to be collapsed in any sort of manner in order to reduce the overall envelope of the arm brace when not in use by a shooter.

Accordingly, need exists for an arm brace for use with a firearm which has an at least partially collapsible profile for ease of transport and handling.

SUMMARY

Disclosed is an arm brace apparatus for use with a firearm which allows for a reduced form factor when the arm brace is not needed by the shooter. The arm brace apparatus includes a hinge which allows for a substantial portion of the brace to pivot between an open or deployed configuration, a useful position when shooting, and a closed or stowed position, useful for transportation or storage of the firearm to which the arm brace is attached.

According to one aspect of the disclosure, an arm brace apparatus comprises first arm brace body member pivotally attached to a second arm brace body member. The second body member may be pivoted from a first position normal to the axis of a firearm extension or buffer tube, and, therefore, also likely the axis of the firearm barrel, to a second position parallel to the axis of the firearm extension. In embodiments, the brace apparatus may be coupled with a buffer tube secured to a firearm and may also include a strap and buckle extending around the perimeter exterior of the arm brace apparatus to facilitate use thereof.

According to another aspect of the disclosure, an arm brace apparatus for use with a firearm extension having an axis, the apparatus comprises: a first body member having a first end securable to the firearm extension; and a second body member pivotally coupled to a second end of the first body member, wherein the second body member is pivotable from a first operational position relative to the first body member, in which the second body member is normal to the axis of the firearm extension, to a second operational position relative to the first body member, in which the second body member is parallel to the axis of the firearm extension.

DESCRIPTION THE DRAWINGS

Various aspects of the present disclosure are described herein below with reference to the drawings, wherein.

Figures 11A, 11B:
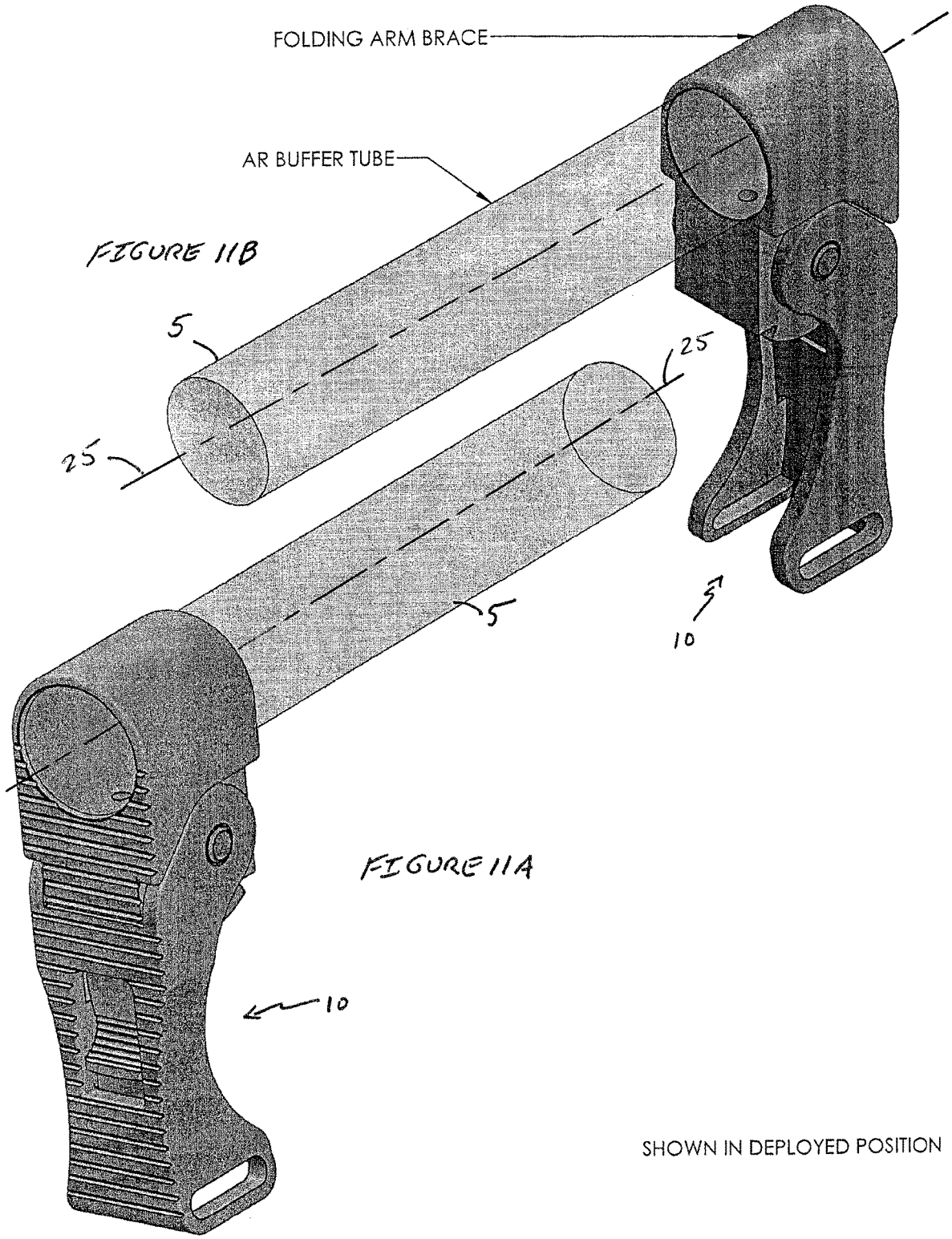
Figures 11C, 11D:
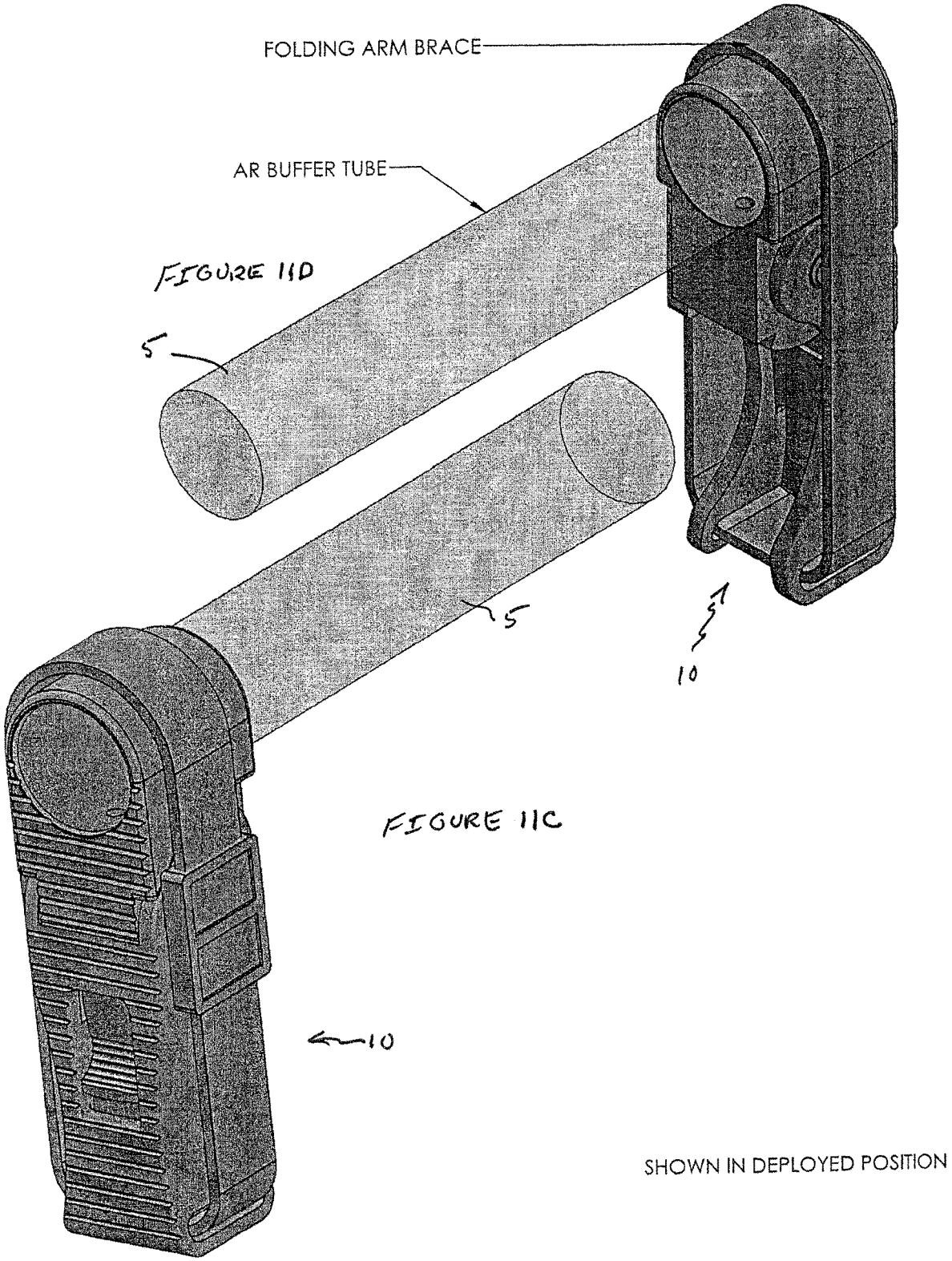
Figure 12B:
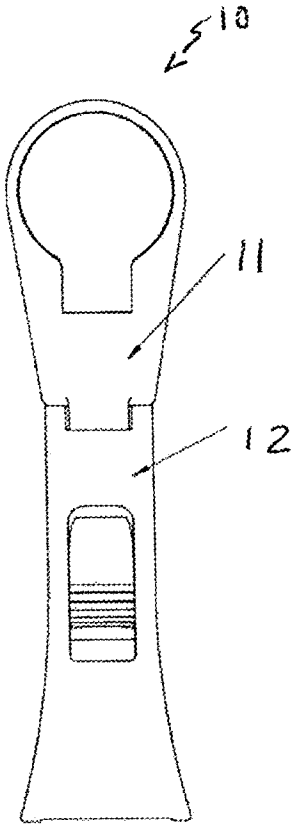
Figure 12A:
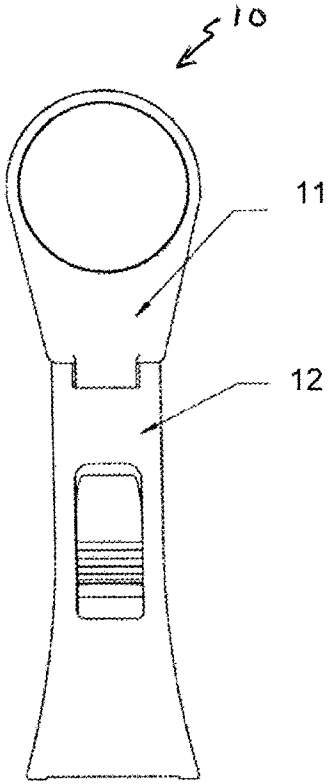

FIGS. 11A-B are perspective views of an assembled embodiment of the underfolding arm brace, shown in the deployed position, in accordance with the disclosure;

FIGS. 11C-D are perspective views of an assembled embodiment of the underfolding arm brace, shown in the deployed position, including an attachable strap, in accordance with the disclosure; and FIGS. 12A-B are front, end-on views of the underfolding arm brace, shown in the deployed position, in accordance with other embodiments of the disclosure.

DETAILED DESCRIPTION

Embodiments of the systems and methods are now described in detail with reference to the drawings in which like reference numerals designate identical or corresponding elements in each of the several views. Throughout this description, the phrase "in embodiments" and variations on this phrase generally is understood to mean that the particular feature, structure, system, or method being described includes at least one iteration of the disclosed technology. Such phrase should not be read or interpreted to mean that the particular feature, structure, system, or method described is either the best or the only way in which the embodiment can be implemented. Rather, such a phrase should be read to mean an example of a way in which the described technology could be implemented, but need not be the only way to do so.

Figure 10A:
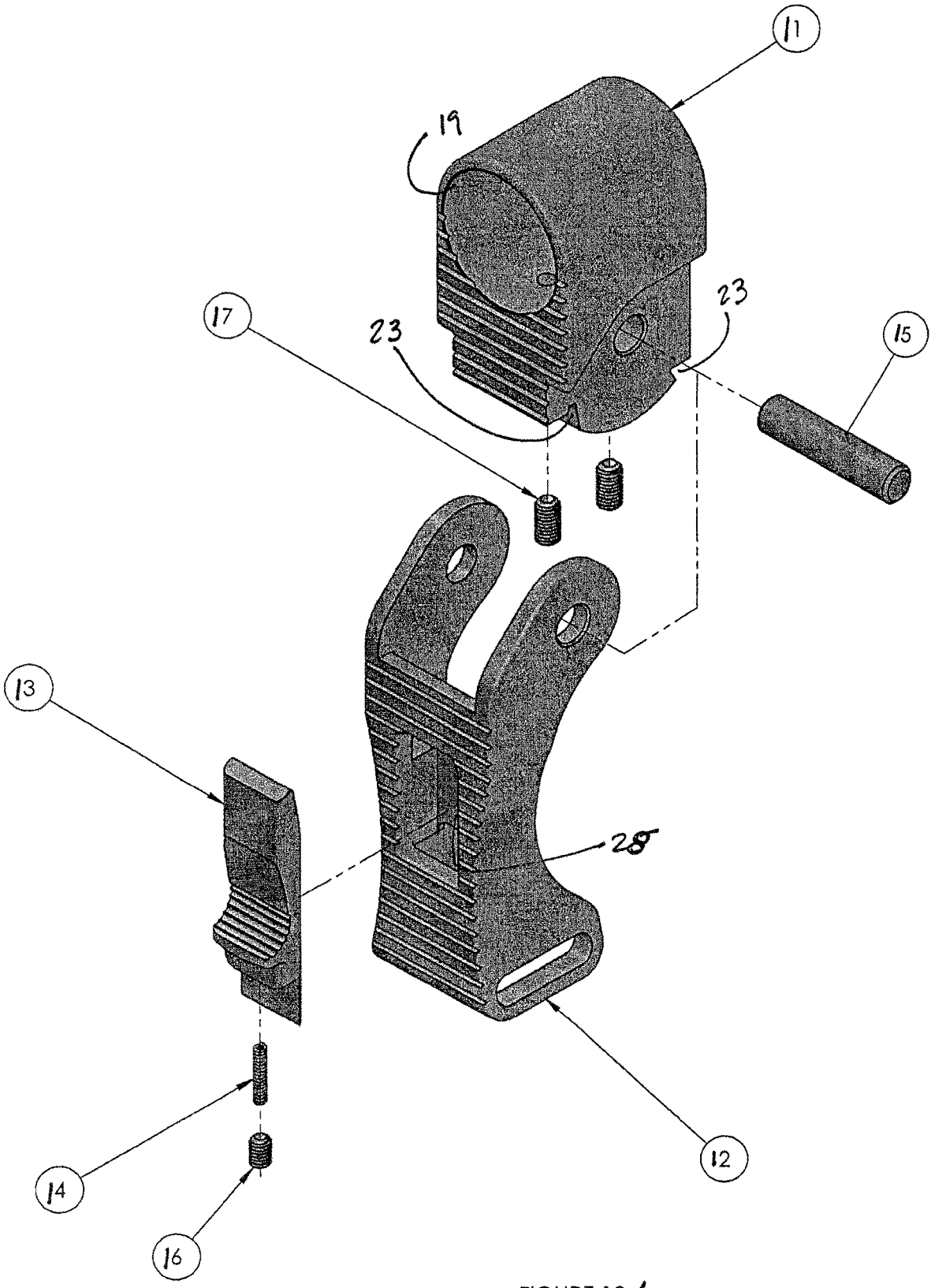
FIG. 10A is an exploded view of an assembled embodiment of the underfolding arm brace, shown in the deployed position, in accordance with the disclosure.
Figure 10B:
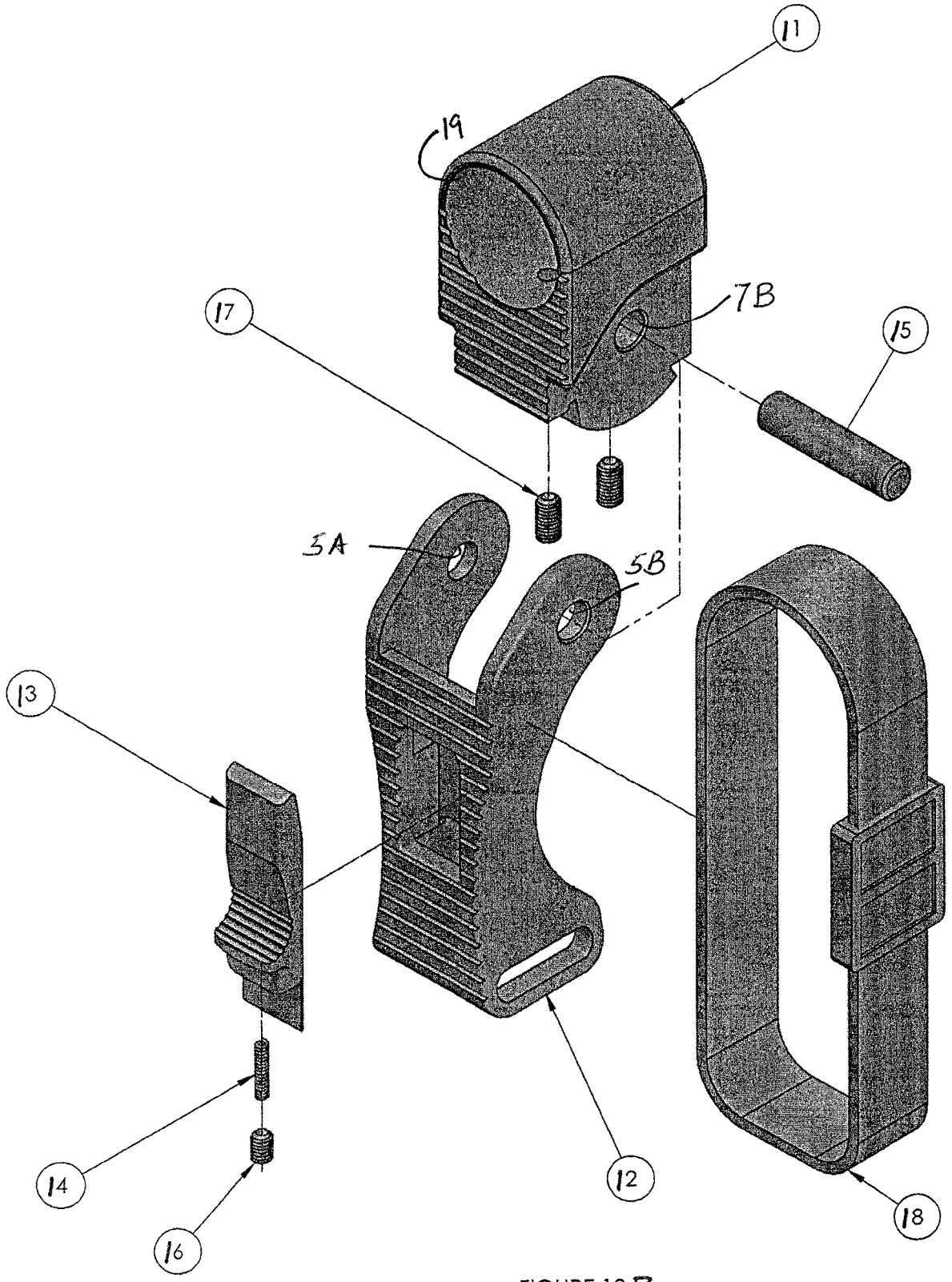
FIG. 10B is an exploded view of an assembled embodiment of the underfolding arm brace, shown in the deployed position, including an attachable strap, in accordance with the disclosure.

Referring to FIGS. 11A-B, an arm brace apparatus 10 is illustrated from different perspective views as attached to a firearm extension device, e.g., buffer tube 5, which itself may be attached to a firearm. Referring to FIGS. 10A-B, arm brace apparatus 10 comprises first arm brace body member 11 pivotally attached to a second arm brace body member 12. A matching pair of apertures 5A-B and 7A-B in body members 12 and 11, respectively, may be aligned to receive a pivot pin 15 therein to enable pivoting movement between the body members 11 and 12. First arm brace body member 11 includes a cylindrical aperture 19 extending at least partially therethrough for receiving one end of the buffer tube 5. A pair of set screws 17 are movable within threaded apertures 21 extending through first body member 11 into the cylindrical aperture 19 allowing for the set screws 17 to be advanced against the body of buffer tube 5 and secured thereagainst so that brace apparatus 10 is secured to buffer tube 5.

In the disclosed embodiment, second body member 12 may be pivoted from a first position normal to the axis 25 of the buffer tube, and, therefore, also the axis of the firearm barrel, to a second position parallel to axis 25. Note that first body member 11 may be secured to buffer tube 5 at any radial angle relative to axis 25, resulting in the second body member 12 being stowed or pivoted in a position parallel to axis 25.

Figure 1A:
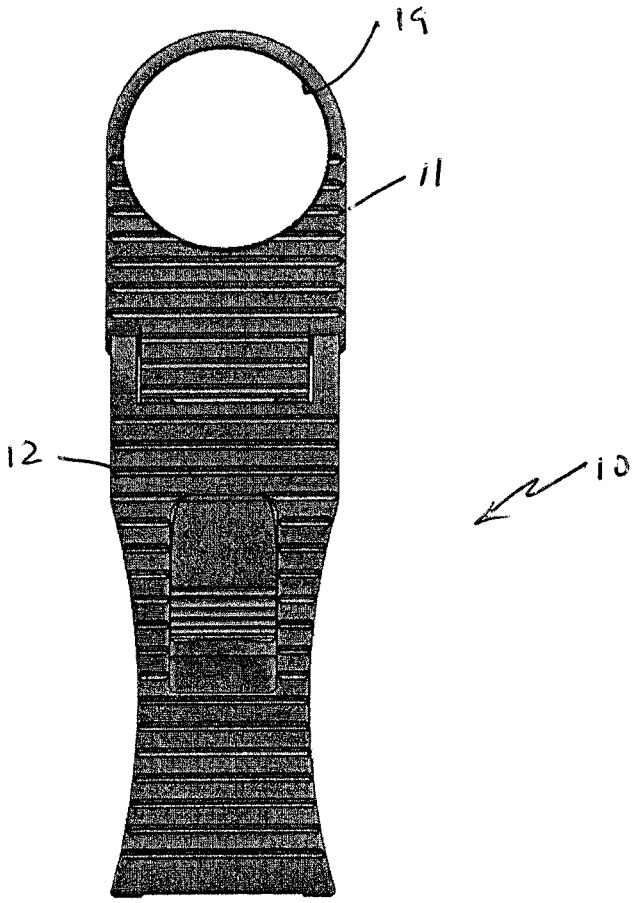
FIG. 1A is a front, end-on view of an embodiment of the underfolding arm brace, shown in the deployed position, in accordance with the disclosure.
Figure 1B:
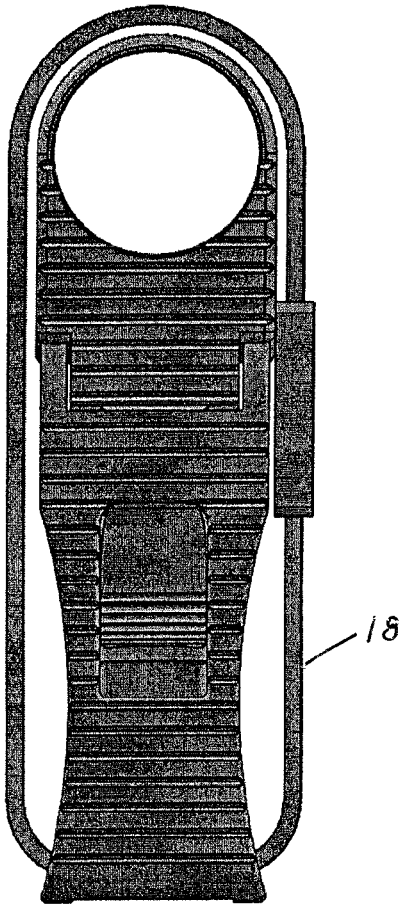
FIG. 1B is a front, end-on view of an embodiment of the underfolding arm brace, shown in the deployed position, including an attachable strap, in accordance with the disclosure.
Figure 2A:
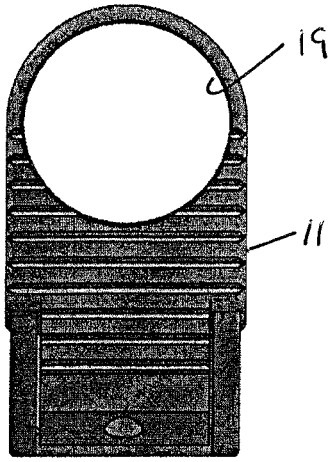
FIG. 2A is a front, end-on view of an embodiment of the underfolding arm brace, shown in the stowed position, in accordance with the disclosure.
Figure 2B:
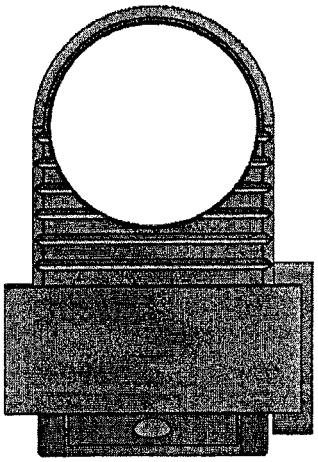
FIG. 2B is a front, end-on view of an embodiment of the underfolding arm brace, shown in the stowed position, including an attachable strap, in accordance with the disclosure.
Figure 3A:
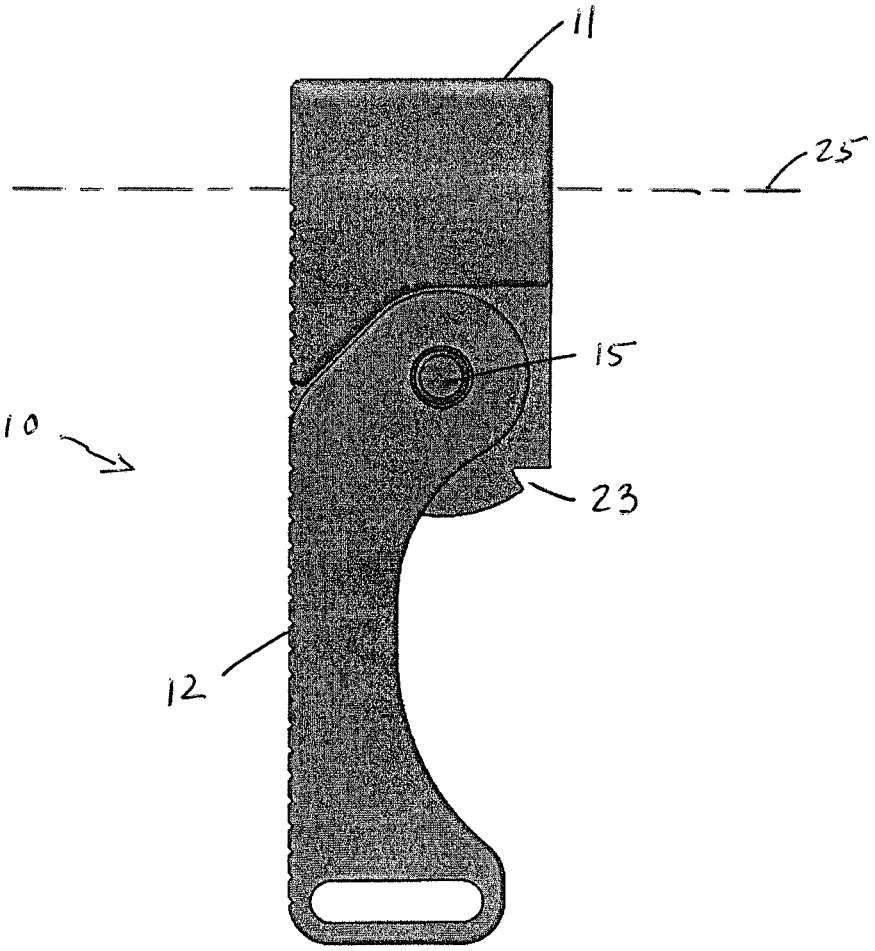
FIG. 3A is a side, plan view of an embodiment of the underfolding arm brace, shown in the deployed position, in accordance with the disclosure.
Figure 3B:
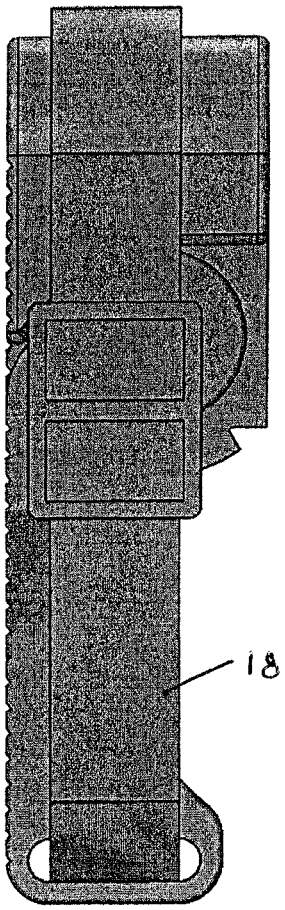
FIG. 3B is a side, plan view of an embodiment of the underfolding arm brace, shown in the deployed position, including an attachable strap, in accordance with the disclosure.
Figure 4A:
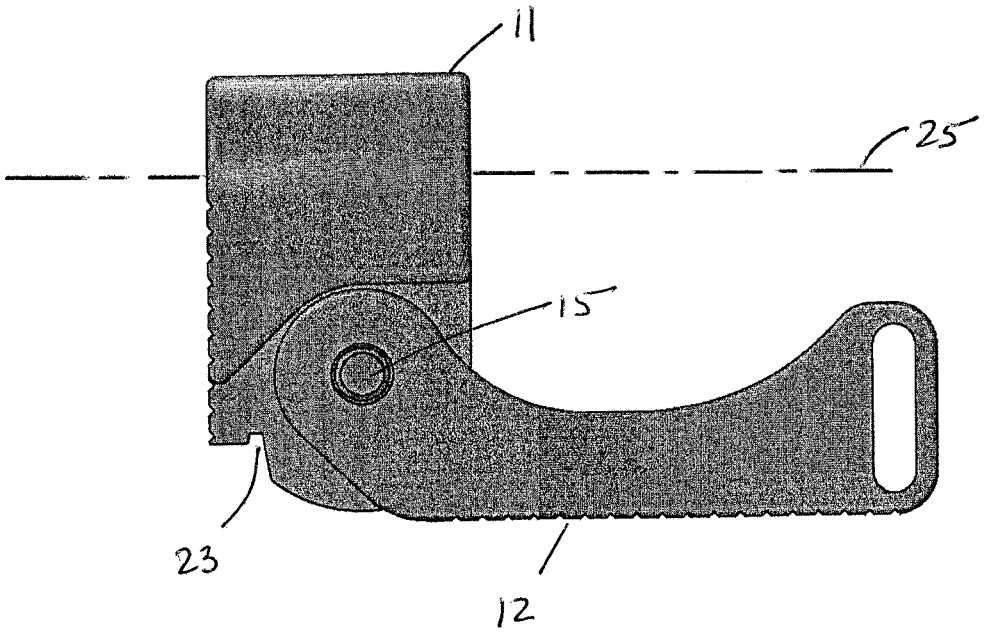
FIG. 4A is a side, plan view of an embodiment of the underfolding arm brace, shown in the stowed position, in accordance with the disclosure.
Figure 4B:
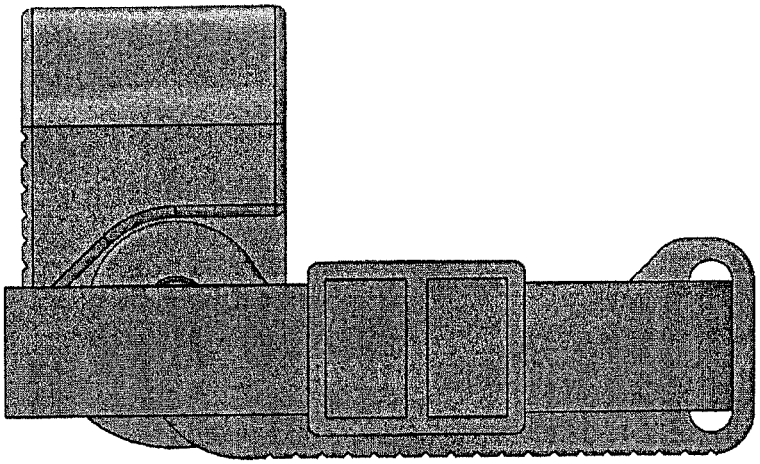
FIG. 4B is a side, plan view of an embodiment of the underfolding arm brace, shown in the stowed position, including an attachable strap, in accordance with the disclosure.
Figure 5A:
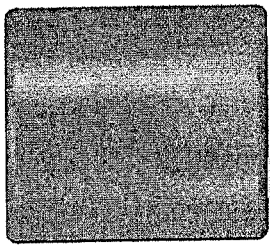
FIG. 5A is a top, plan view of an embodiment of the underfolding arm brace, shown in the deployed position, in accordance with the disclosure.
Figure 5B:
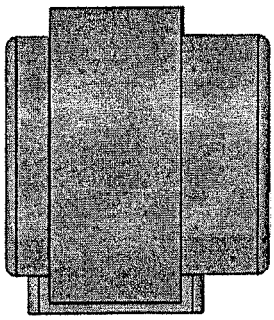
FIG. 5B is a top, plan view of an embodiment of the underfolding arm brace, shown in the deployed position, including an attachable strap, in accordance with the disclosure.
Figure 6A:
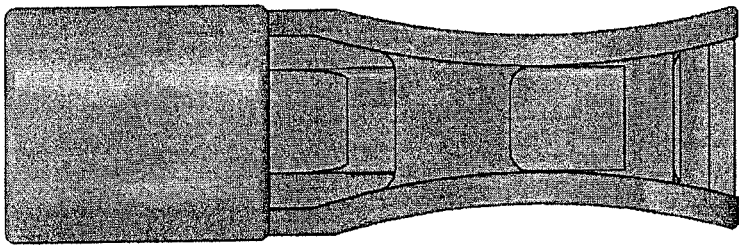
FIG. 6A is a top, plan view of an embodiment of the underfolding arm brace, shown in the stowed position, in accordance with the disclosure.
Figure 6B:
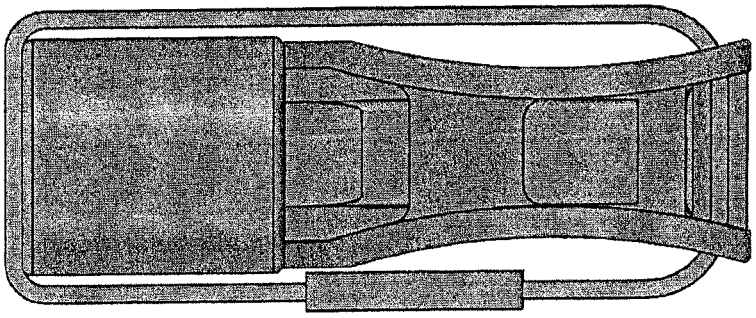
FIG. 6B is a top, plan view of an embodiment of the underfolding arm brace, shown in the stowed position, including an attachable strap, in accordance with the disclosure.
Figure 7A:
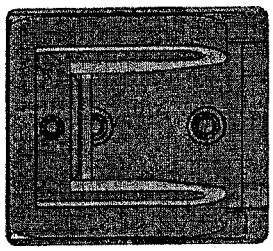
FIG. 7A is a bottom, plan view of an embodiment of the underfolding arm brace, shown in the deployed position, in accordance with the disclosure.
Figure 7B:
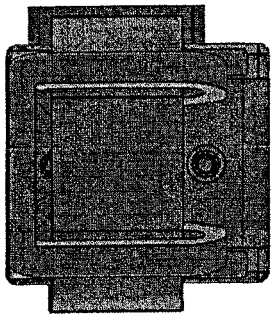
FIG. 7B is a bottom, plan view of an embodiment of the underfolding arm brace, shown in the deployed position, including an attachable strap, in accordance with the disclosure.
Figure 8A:
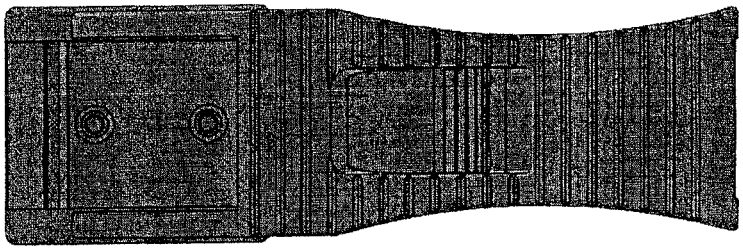
FIG. 8A is a bottom, plan view of an embodiment of the underfolding arm brace, shown in the stowed position, in accordance with the disclosure.
Figure 8B:
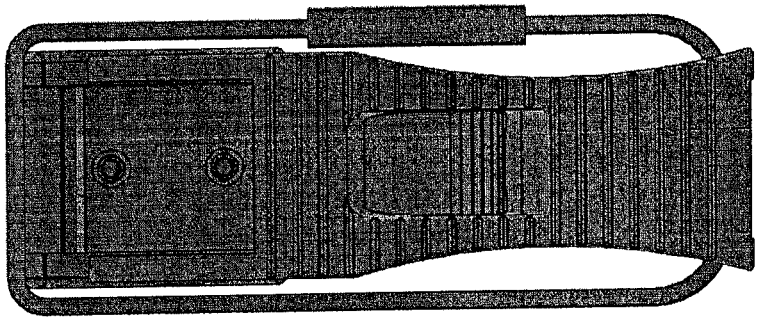
FIG. 8B is a bottom, plan view of an embodiment of the underfolding arm brace, shown in the stowed position, including an attachable strap, in accordance with the disclosure.
Figure 9A:
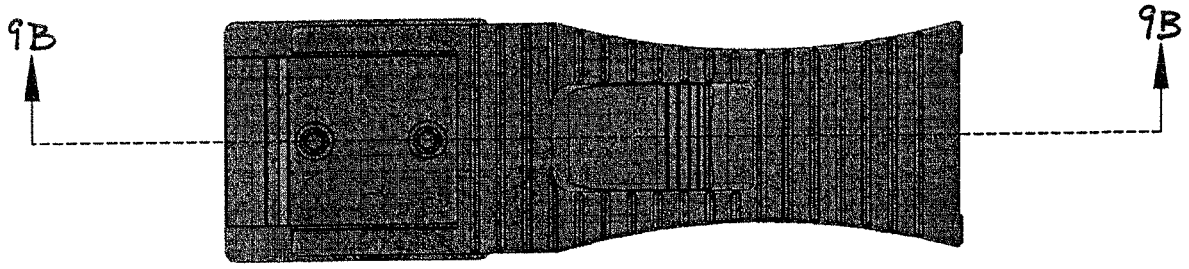
FIG. 9A is a bottom, plan view of an embodiment of the underfolding arm brace, shown in the stowed position, in accordance with the disclosure.
Figure 9B:
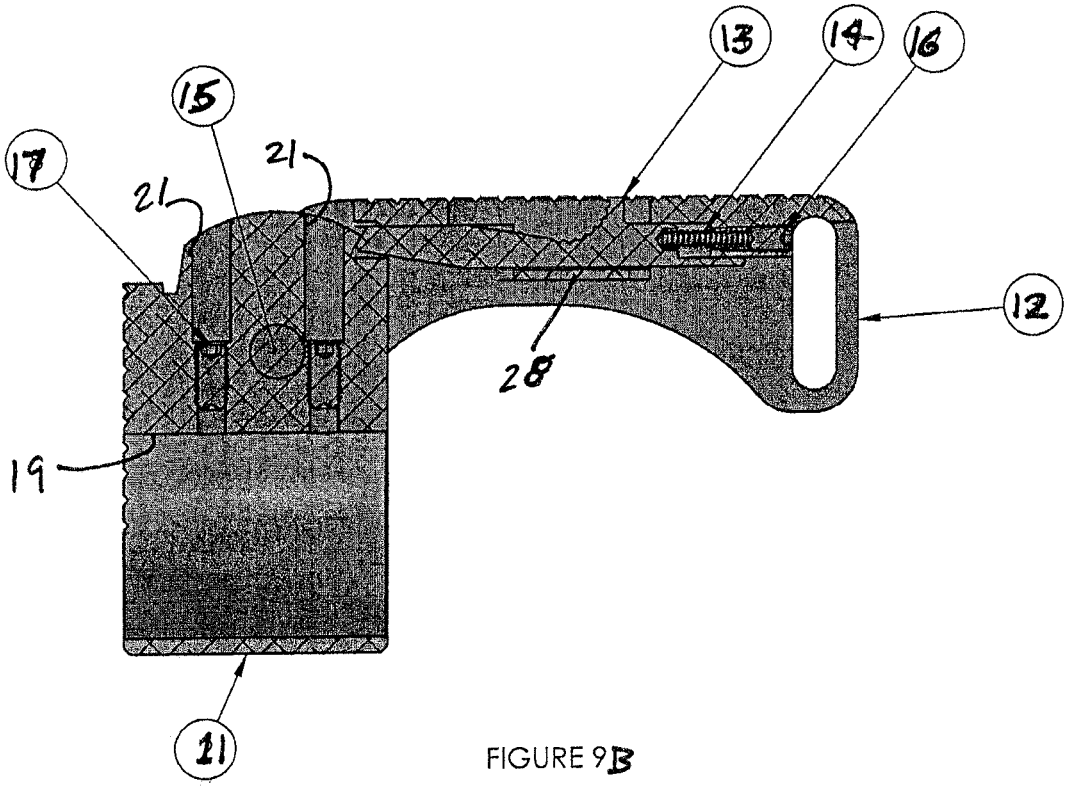
FIG. 9B is a cross-sectional view of an assembled embodiment of the underfolding arm brace shown in the stowed position, as seen along line 9B-9B in FIG. 9A, in accordance with the disclosure.
Figure 9C:
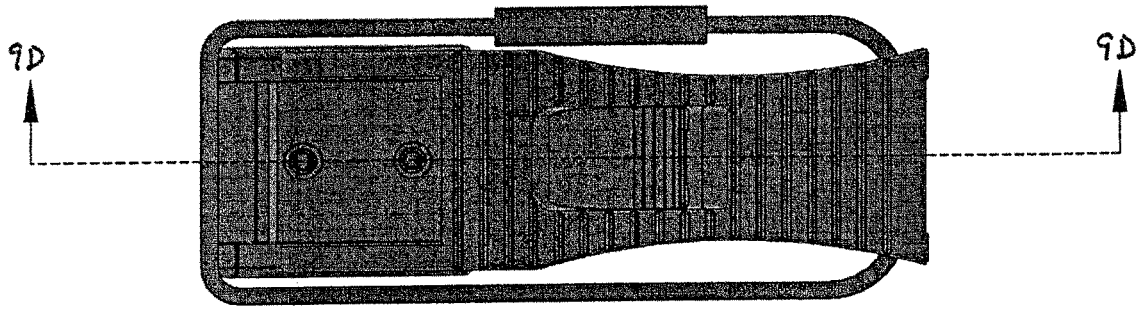
FIG. 9C is a bottom, plan view of an embodiment of the underfolding arm brace, shown in the stowed position, including an attachable strap, in accordance with the disclosure.
Figure 9D:
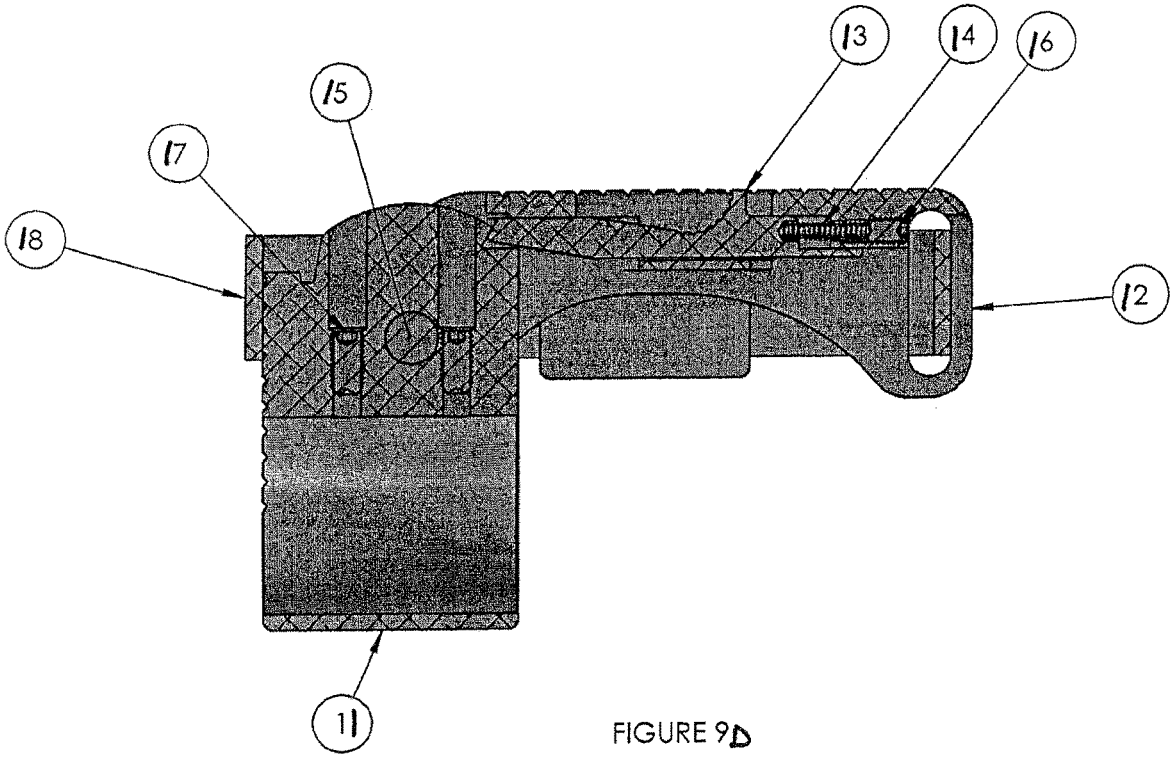
FIG. 9D is a cross-sectional view of an assembled embodiment of the underfolding arm brace shown in the stowed position, as seen along line 9D-9D in FIG. 9C, in accordance with the disclosure.

Arm brace apparatus 10 further comprises a latch 13 slidably secured within second body member 12 to enable body members 11 and 12 to be locked into a deployed configuration in which their respective textured rear facing surfaces are coplanar, as illustrated in FIGS. 3A-B, or further locked into a stowed configuration in which their respective textured rear surfaces are disposed normal to each other, as illustrated in FIGS. 4A-B. In embodiments, latch 13 includes at one end thereof a wedge shaped end which is receivable within either of grooves 23 of first body member 11, depending upon whether the apparatus 10 is in a deployed or stowed configuration. Latch 13 is slidably secured in first body member 11 with a bracket 28 formed in an open cavity of second body member 12. The wedge end of latch 13 is biased against grooves 23 of first body member 11, by a latch spring 14 and set screw 16 and retained thereagainst until counter pressure is applied to the contoured surface of latch 13 to release the latch and allow pivoting of second body member 12 relative to first body member 11.

As illustrated, the free end of second body member 12 includes a pair of apertures 27 into which a strap 18 and buckle may be threaded and secured to apparatus 10 as illustrated.

In embodiments, body members 11 and 12 may be each separately and integrally formed of a rigid material such as natural or synthetic polymers, ballistic plastics, metal, or other suitable materials. As illustrated, one or more surfaces of apparatus 10 may be textured to facilitate easier gripping.

FIGS. 12A-B illustrate front, end-on views of the underfolding arm brace, shown in the deployed position, in accordance with other embodiments of the disclosure. In the embodiments of FIG. 12A-B the first and second body members 11 and 12, respectively, have slightly different exterior profile contours, however, the construction and function of the apparatus 10 is substantially similar to that as described herein.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope and spirit of the claims appended hereto.

What is claimed is:

1. An arm brace apparatus for use with a firearm extension, the firearm extension having an axis, the apparatus comprising:

a first body member having a primary aperture extending at least partially therethrough and configured to at least partially receive a firearm extension;

a second body member pivotally coupled to an end of the first body member;

a firearm extension locking mechanism disposed proximate the primary aperture in the first body member and comprising at least one secondary aperture opening into the primary aperture and a movable locking piece selectively advanceable and retractable within the secondary aperture to selectively secure the firearm extension within the primary aperture, and wherein the second body member is pivotable between a first operational position relative to the first body member, in which the second body member is normal to the axis of the firearm extension, and a second operational position relative to the first body member, in which the second body member is parallel to the axis of the firearm extension.

2. The apparatus of claim 1 wherein the secondary aperture comprises a threaded aperture and the movable locking piece comprises a set screw.

3. The apparatus of claim 1 wherein the frictionally engaging element comprises a pair of secondary apertures opening into the primary aperture and a pair of movable locking pieces, each selectively advanceable and retractable in one of the secondary apertures to selectively secure the firearm extension within the primary aperture.

4. The apparatus of claim 3 wherein the secondary apertures comprise a pair of threaded apertures and the movable locking pieces comprise a pair of set screws.

5. The apparatus of claim 1 wherein the primary aperture is cylindrical.

6. The apparatus of claim 1 wherein the end of the first body member and an end of the second body member have a pair of matching apertures extending therethrough.

7. The apparatus of claim 6 wherein the apparatus further comprises a pin disposed within the pair of matching apertures in the first and second body members to rotatably couple the first body member to second body member.

8. An arm brace apparatus for use with a firearm extension, the firearm extension having an axis, the apparatus comprising:

a first body member having a first end securable to the firearm extension;

a second body member pivotally coupled to a second end of the first body member; and a pivot locking mechanism disposed on one of the first body member and second body member for selectively securing positions of the first body member and second body member relative to one another, wherein the second body member is pivotable between a first operational position relative to the first body member, in which the second body member is normal to the axis of the firearm extension, and a second operational position relative to the first body member, in which the second body member is parallel to the axis of the firearm extension.

9. The apparatus of claim 8 wherein the pivot locking mechanism is disposed on the second body member.

10. The apparatus of claim 8 wherein the pivot locking mechanism is disposed on the first body member.

11. The apparatus of claim 8 wherein the pivot locking mechanism comprises a latch slidably coupled to the second body member.

12. The apparatus of claim 11 wherein the pivot locking mechanism further comprises a biasing element for urging the latch in a direction towards the first body member.

13. The apparatus of claim 12 wherein the biasing element comprises a spring.

14. The apparatus of claim 11 wherein the first body member further comprises a first groove configured for at least partially receiving the latch therein to lock the second body member into the first operational position relative to the first body member wherein exterior surfaces of the first and the second body members are coplanar.

15. The apparatus of claim 11 wherein the first body member further comprises a second groove configured for at least partially receiving the latch therein to lock the second body member into the second operational position relative to the first body member wherein exterior surfaces of the first and the second body members are normal to each other.

16. The apparatus of claim 14 wherein the exterior surfaces of one of the first and the second body members are textured to enhance frictional engagement therewith.

* * * * *